US006503571B1

(12) United States Patent
Bonino et al.

(10) Patent No.: US 6,503,571 B1
(45) Date of Patent: Jan. 7, 2003

(54) COATING METHOD AND APPARATUS WITH SUBSTRATE EXTENSION DEVICE

(75) Inventors: Christopher A. Bonino, Ontario, NY (US); Mark C. Petropoulos, Ontario, NY (US); Michael J. Duggan, Webster, NY (US); L. John Potter, Walworth, NY (US); Stanley J. Pietrzykowski, Jr., Rochester, NY (US); Shaun Selha, Allston, MA (US); Mark S. Thomas, Williamson, NY (US); Eugene A. Swain, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/903,018

(22) Filed: Jul. 11, 2001

(51) Int. Cl.[7] ..... B05D 1/18
(52) U.S. Cl. ..... 427/430.1
(58) Field of Search ..... 427/430.1; 118/428

(56) References Cited

U.S. PATENT DOCUMENTS

| | | | | |
|---|---|---|---|---|
| 5,385,759 A | | 1/1995 | Crump et al. | 427/430.1 |
| 5,422,144 A | * | 6/1995 | Speakman, Jr. | 427/430.1 |
| 5,578,410 A | | 11/1996 | Petropoulos et al. | 430/133 |
| 5,829,760 A | | 11/1998 | Mistrater et al. | 279/2.22 |
| 6,214,419 B1 | * | 4/2001 | Dinh et al. | 427/430.1 |

* cited by examiner

*Primary Examiner*—Michael Barr
(74) *Attorney, Agent, or Firm*—Zosan S. Soong

(57) ABSTRACT

A coating method for a hollow substrate including: (a) forming a seamed extended substrate unit composed of a substrate extension device and the substrate, and employing a chuck assembly to internally grip the substrate; (b) dip coating the extended substrate unit while the chuck assembly internally grips the substrate to deposit a layer first on the substrate extension device and then on the substrate; and (c) separating, subsequent to the dip coating the extended substrate unit, the substrate extension device from the substrate.

9 Claims, 5 Drawing Sheets

COATING METHOD AND APPARATUS WITH SUBSTRATE EXTENSION DEVICE

BACKGROUND OF THE INVENTION

Dip coating is a well known method for depositing layered material onto a substrate. In many situations, it is desirable for the dip coated layer to have a substantially uniform thickness along the length of the substrate. During dip coating, however, sloping of the deposited layer may occur due to the acceleration of the substrate from 0 speed to the desired take-up speed and due to non-uniform gravitational flow from the starting point to where steady state is achieved, thereby resulting in a portion of the deposited layer exhibiting a non-uniform thickness. There is a need, which the present invention addresses, for new methods and apparatus that can minimize or eliminate the sloping phenomenon for layered material dip coated onto a substrate.

Conventional dip coating methods and apparatus are illustrated in Petropoulos et al., U.S. Pat. No. 5,578,410; Crump et al., U.S. Pat. No. 5,385,759; and Mistrater et al., U.S. Pat. No. 5,829,760.

SUMMARY OF THE INVENTION

The present invention is accomplished in embodiments by providing a coating method for a hollow substrate comprising:

(a) forming a seamed extended substrate unit comprised of a substrate extension device and the substrate, and employing a chuck assembly to internally grip the substrate;

(b) dip coating the extended substrate unit while the chuck assembly internally grips the substrate to deposit a layer first on the substrate extension device and then on the substrate; and (c) separating, subsequent to the dip coating the extended substrate unit, the substrate extension device from the substrate.

In other embodiments, there is provided an apparatus comprising:

(a) a chuck assembly capable of internally gripping a hollow substrate; and (b) a substrate extension device, coupled to the chuck assembly, positioned adjacent an end of the substrate resulting in a seamed extended substrate unit.

There is also provided in embodiments an apparatus comprising:

(a) a chuck assembly capable of internally gripping a hollow substrate; and (b) a substrate extension device, not coupled to the chuck assembly, positioned adjacent an end of the substrate resulting in a seamed extended substrate unit.

BRIEF DESCRIPTION OF THE DRAWINGS

Other aspects of the present invention will become apparent as the following description proceeds and upon reference to the Figures which represent various embodiments.

Unless otherwise noted, the same reference numeral in different Figures refers to the same or similar feature.

DETAILED DESCRIPTION

Figure 1:
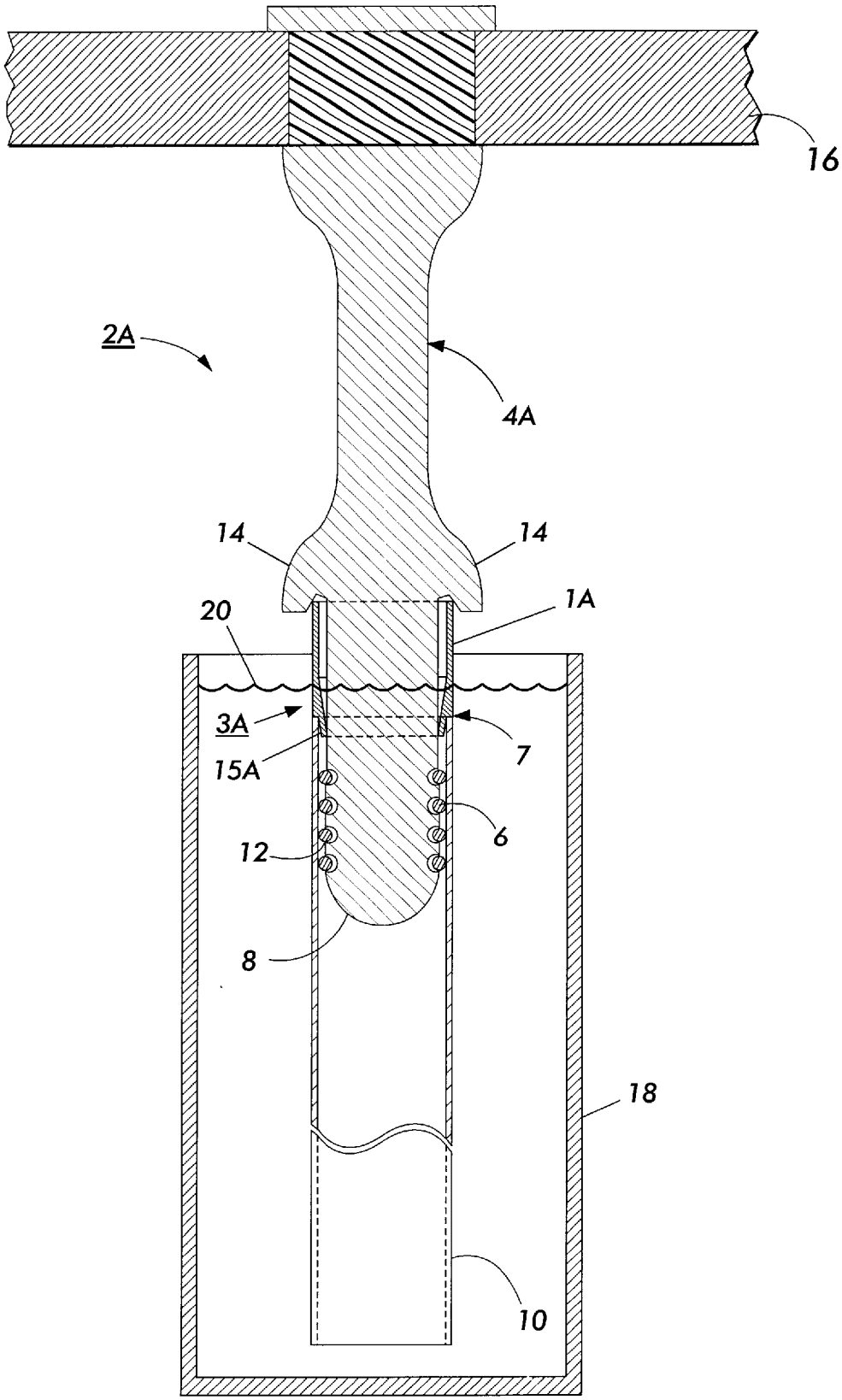
FIG. 1 depicts an elevational view in cross-section of a first embodiment of the present invention.

In FIG. 1, the substrate extension device 1A is positioned adjacent an end of the substrate 10 to result in an extended substrate unit 3A having a seam 7 between the substrate extension device and the substrate. The chuck assembly 2A extends through the substrate extension device and into the substrate to internally grip the substrate. In FIG. 1, the substrate extension device 1A is not coupled to the chuck assembly 2A. During dip coating, the chuck assembly positions the substrate and the substrate extension device in a vessel 18 containing a coating solution 20.

It may be feasible in certain embodiments of the present invention for the substrate extension device and the substrate to contact each other only in an end edge to end edge contact. However, the substrate extension device and the substrate may engage each other in a manner that increases the likelihood that the extended substrate unit will stay together during dip coating. For example, the substrate extension device may include an engaging surface 15A, 15B. The engaging surface contacts the interior surface of the substrate and an end edge of the substrate to seat the end of the substrate. In embodiments, the substrate may have an engaging surface. It is also feasible to use a connecting apparatus (not shown) between the substrate and the substrate extension device to form the extended substrate unit composed of the substrate, connecting apparatus, and substrate extension device. This connecting apparatus engages both the substrate and the substrate extension device and may be for example another substrate extension device.

FIG. 1 illustrates a chuck assembly 2A including a generally cylindrically shaped body 4A and a spring 6. The body 4A has an end section 8 having a width narrower than that of the inner width of the substrate extension device 1A and of the substrate 10. The end section 8 may have a cylindrical shape and optionally defines a groove 12 encircling the end section to receive the spring. The groove 12 may have a depth ranging for example from about 0.5 mm to about 10 mm. The body 4A may be formed of two or more pieces joined together, but may be a single piece. A flared region 14 on the body may be present to position the end of the substrate extension device on the body 4A. The body may be fabricated from a metal like steel or aluminum or a plastic such as TEFLON™. The other end of the body is coupled to a pallet 16, which can hold a plurality of chuck assemblies ranging in number from 2 to 400 (not shown).

The spring 6 is a radial spring that coils around the outer surface of a portion of the end section. The phrase radial spring indicates that the spring is circumferential, i.e, it resides on the circumference of the body 4A such as at end section 8. The spring collapses or is compressed in the direction of the radius line of the end section 8. To provide a snug fit with the end section 8, the spring 6 may have an inner width (distance between opposite inner surfaces of a coil) slightly smaller than the width of the end section such as about 2% to about 10% smaller. In those embodiments where the spring 6 is disposed in the groove 12, the reduction in end section width caused by the presence of the groove should be taken into account when determining the spring inner width. To position the spring, the spring is pulled onto the end section into the groove, where each coil of the spring is disposed in one circumferential groove, with the number of grooves matching the number of coils. After placement on the end section, but prior to compression, the spring has an outer width (distance between opposite outer surfaces of a coil) slightly larger than that of the substrate inner width such as about 2% to about 10% larger, even when the spring is disposed in the groove. Prior to compression, the spring 6 may extend beyond the surface of the end section 8, even when the spring is disposed in the groove 12, by a thickness ranging from about 0.5 mm to about 2 mm. The spring has a number of coils ranging from about 5 to about 40, preferably from about 10 to about 20. Although some coils may fail to contact the substrate inner surface, it is preferred that all of the coils contact the substrate inner surface. The spring may be fabricated from any suitable material such as a metal like stainless steel or a plastic such as polypropylene. A durable spring material such as stainless steel is preferred since the substrate end may be rather sharp and repeated contact of the spring with a plurality of substrates may present a wear problem for the spring. The spring may have the following preferred dimensions: an outer width ranging from about 2 mm to about 10 cm, and a thickness of the wire forming each coil ranging from about 0.2 mm to about 2 mm. The number of coils per unit length may range for example from about 5 to about 25 coils/inch. Preferably, only the spring of the chuck assembly contacts the inner surface of the substrate, but a portion of the end section surface may also contact the substrate inner surface.

Preferably, there is absent any movable parts such as a slidable rod within the chuck assembly (the spring is not considered a movable part for purposes of this discussion). The materials of the chuck assembly are selected to withstand the temperature changes, chemicals, and chemical fumes associated with for example a dip coating process used in the fabrication of photosensitive members.

Operation of the chuck assembly of FIG. 1 proceeds as follows. The substrate extension device is placed (manually by an operator or by automated equipment) on top of the substrate in an end to end manner to form the extended substrate unit. The pallet 16 moves the chuck assembly 2A over the open end of the extended substrate unit and the end section 8 is inserted into the extended substrate unit where contact with the inner surface of the extended substrate unit compresses the spring 6 against the end section 8. The end section is inserted until the open end of the extended substrate unit is positioned against the flared region 14 of the body where the spring contacts the substrate inner surface. The chuck assembly holds the substrate by the force generated against the substrate inner surface by the spring in opposition to the compression. The substrate extension device may be held in place by compression force between the substrate and the chuck assembly. Preferably, there is no rotation of the chuck assembly during its operation.

Figure 2:
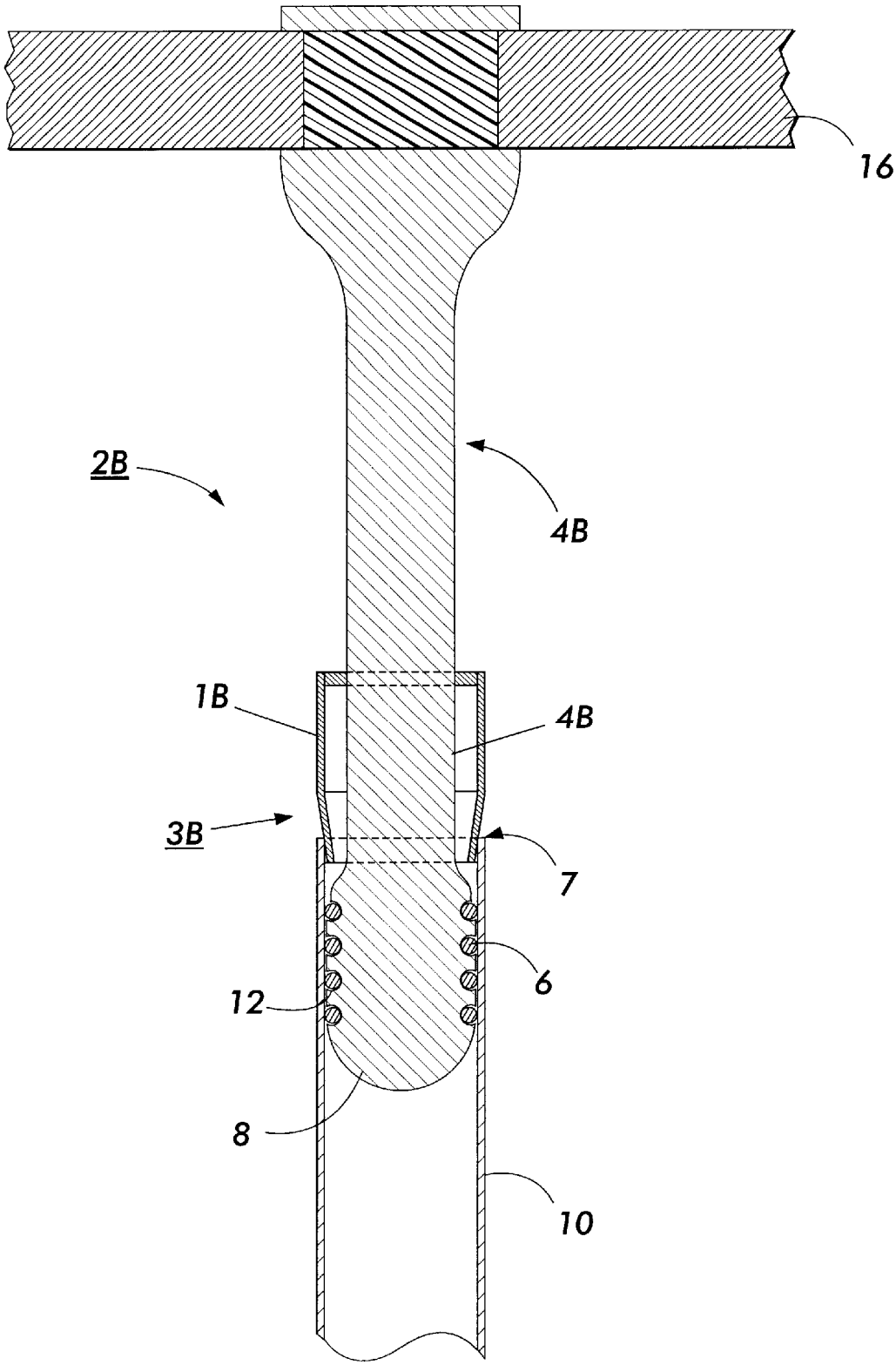
FIG. 2 depicts an elevational view in cross-section of a second embodiment of the present invention.

FIG. 2 depicts another embodiment of the present invention where the substrate extension device 1B is permanently coupled (e.g., welding) or detachably coupled (e.g., screws) to body 4B of the chuck assembly 2B. Extended substrate unit 3B is composed of substrate 10 and substrate extension device 1B.

Figure 3:
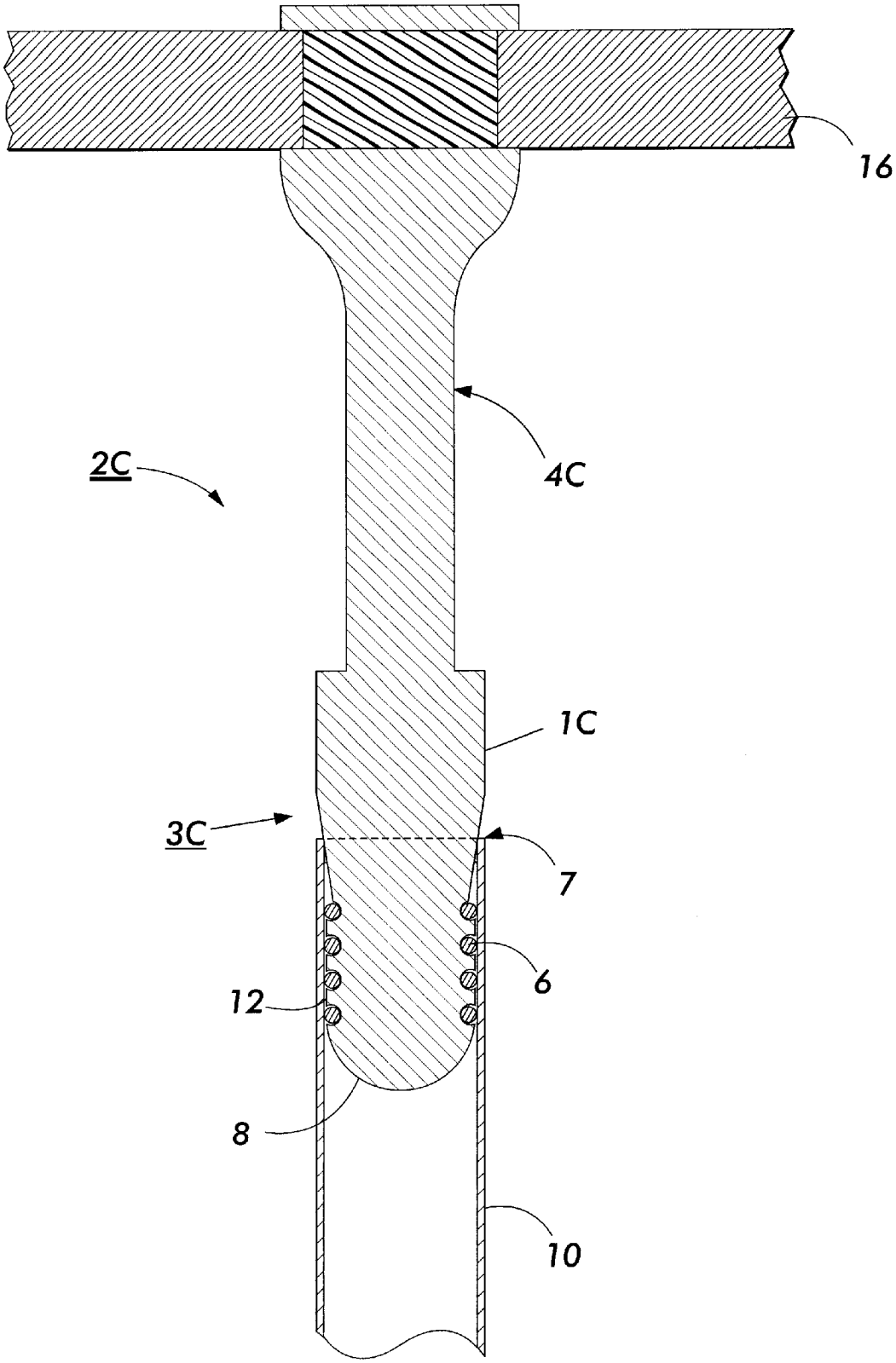
FIG. 3 depicts an elevational view in cross-section of a third embodiment of the present invention.

FIG. 3 illustrates a chuck assembly 2C where a portion of its body 4C is shaped into the substrate extension device 1C. This illustrates a way of permanently coupling the substrate extension device 1C to the chuck assembly 2C. Extended substrate unit 3C is composed of substrate 10 and substrate extension device 1C.

FIGS. 1–3 depict embodiments of the present invention where the substrate and the substrate extension device are cylindrically shaped having the same outer width, resulting in the outer surface of the substrate extension device being parallel to the outer surface of the substrate.

Figure 4:
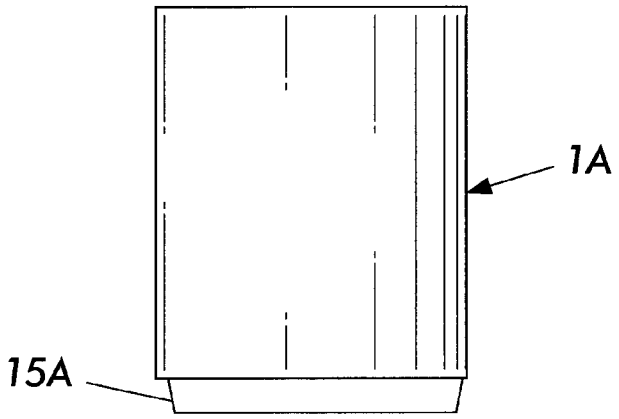
FIG. 4 depicts an elevational view of the substrate extension device employed in FIG. 1.

FIG. 4 depicts a version of the substrate extension device 1A having the engaging surface 15A.

Figure 5:
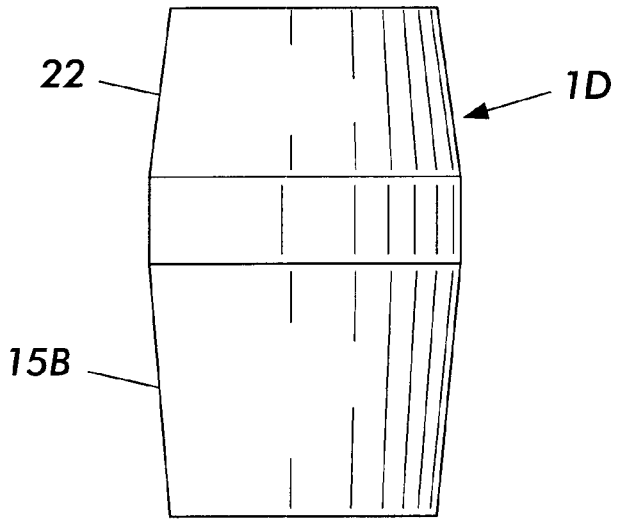
FIG. 5 depicts an elevational view of another embodiment of the substrate extension device.

FIG. 5 depicts another embodiment of the substrate extension device 1D having an inclined surface 22 to receive the dip coated layer and a cone shaped engaging surface 15B.

Figure 6:
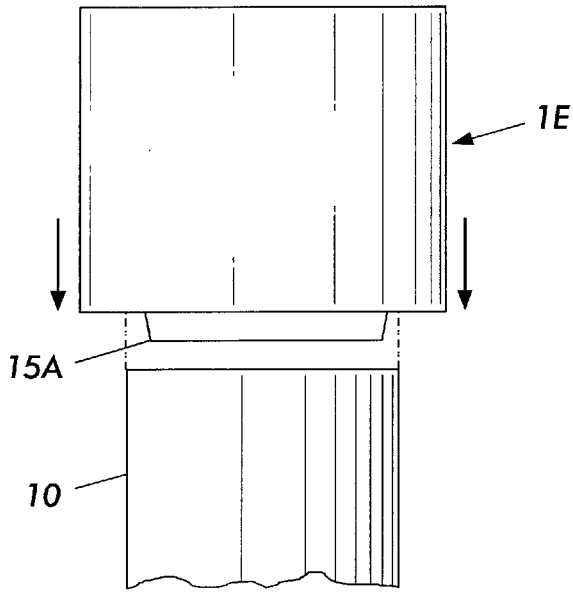
FIG. 6 depicts an elevational exploded view of a substrate and a different embodiment of the substrate extension device.

FIG. 6 depicts a substrate extension device 1E that has an outer width larger than that of the substrate 10.

Figure 7:
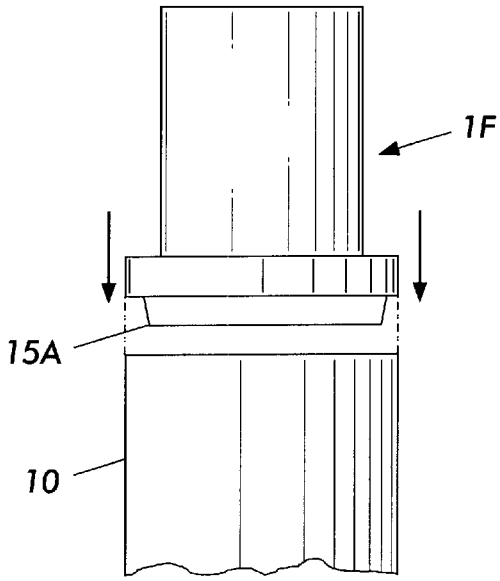
FIG. 7 depicts an elevational exploded view of a substrate and an alternative embodiment of the substrate extension device.

FIG. 7 depicts a substrate extension device 1F that has an outer width smaller than that of the substrate 10.

Any conventional chuck assembly may be used in the present invention such as those illustrated in Fukawa et al., U.S. Pat. No. 5,282,888; Mistrater et al., U.S. Pat. No. 5,322,300; Mistrater et al., U.S. Pat. No. 5,328,181; Mistrater et al., U.S. Pat. No. 5,320,364; and Mistrater et al., U.S. Pat. No. 5,324,049, the disclosures of which are totally incorporated herein by reference. Other suitable chuck assemblies include those disclosed in Swain et al., U.S. Pat. No. 5,520,399 and Swain et al., U.S. Pat. No. 5,688,327, the disclosures of which are totally incorporated herein by reference. It is noted that the chuck assembly depicted in these two patents ('399 patent and '327 patent) are primarily directed to those coating steps requiring a fluid-tight seal between the chuck assembly and the inner surface of the substrate. In embodiments of the present invention, the chuck assembly can maintain a fluid-tight seal with the extended substate unit during dip coating; in other embodiments, there may be no need for the chuck assembly to maintain a fluid-tight seal with the extended substrate unit.

There is at least one seam in the extended substrate unit between the substrate and the substrate extension device. Two seams are present when a connecting apparatus is present between the substrate and the substrate extension device. The seam or seams may be fluid-tight or not fluid-tight. The seam may be made fluid-tight by achieving a compression fit between the substrate and the substrate extension device.

The present chuck assembly and substrate extension device may be employed in the dip coat process material handling system described in Pietrzykowski, Jr. et al., U.S. Pat. No. 5,334,246, the disclosure of which is totally incorporated herein by reference.

An advantage of a substrate extension device that is detachably coupled to the chuck assembly or not coupled to the chuck assembly is that such a substrate extension device may be replaced after a number of dip coating cycles.

Dip coating of the extended substrate unit is now generally described. When the extended substrate unit is coated, the deposition of a layer begins above the substrate on the surface of the substrate extension device. The layer on the substrate extension device may exhibit sloping due to acceleration of the take-up speed from 0 to the desired take-up speed. Depending on the dip coating method, the acceleration may be caused by movement of the extended substrate unit or of the coating vessel, or the withdrawal of the coating solution from the coating vessel. The sloping of the layer on the substrate extension device may occur for the first about 10 mm to about 30 mm length of the substrate extension device. After this distance on the extended substrate unit, the layer is more uniform. Thus, the dip coating may be accomplished such that the layer thickness on the substrate is more uniform than the layer thickness on the substrate extension device. In embodiments, the layer sloping phenomenon is limited to the substrate extension device; the layer sloping phenomenon is absent from the substrate. In other embodiments of the present invention, however, the layer over the region of the substrate adjacent the substrate extension device may exhibit sloping. This is permissible in the event that the sloping of the layer over this substrate region does not signficantly degrade the performance of the resulting coated substrate. For example, substrates for photoreceptors typically contain non-imaging areas on the end regions of the substrates. These non-imaging areas can receive a sloped coating layer since the non-imaging areas are typically not involved with the imaging function of photoreceptors.

Thus, the present dip coating method and apparatus can provide better coating uniformity on the substrate which is beneficial in many situations such as when the coated substrate is used in the fabrication of a photoreceptor. The better coating uniformity of the photoreceptor can increase print quality.

The phrase "dip coating" encompasses the following techniques to deposit layered material onto a substrate: moving the substrate into and out of the coating solution; raising and lowering the coating vessel to contact the solution with the substrate; and while the substrate is positioned in the coating vessel filling the vessel with the solution and then draining the solution from the vessel. The substrate may be moved into and out of the solution at any suitable speed including the take-up speed indicated in Yashiki et al., U.S. Pat. No. 4,610,942, the disclosure of which is hereby totally incorporated herein by reference. The take-up speed profile may be that employed in Petropoulos et al., U.S. Pat. No. 5,578,410, the disclosure of which is totally incorporated herein by reference. The dipping speed may range for example from about 50 to about 1500 mm/min and may be a constant or changing value. The take-up speed during the raising of the substrate may range for example from about 50 to about 500 mm/min and may be a constant or changing value. In one embodiment, the take-up speed is the same or different constant value for all the dip coating steps of the present invention. All the substrates in a batch may be dip coated substantially simultaneously, or simultaneously, in each coating solution. Equipment to control the speed of the substrate during dip coating is available for example from Allen-Bradley Corporation and involves a programmable logic controller with an intelligent motion controller. With the exception of the wet coating solution bead which may be present at the bottom edge of the substrate, the thickness of each wet coated layer on the substrate may be relatively uniform and may be for example from about 1 to about 60 micrometers in thickness. Each coated layer when dried may have a thickness ranging for example from about 0.001 to about 60 micrometers.

The substrate and coating solution are described herein with an emphasis on the manufacture of photoreceptors. However, different substrates and coating solutions than those specifically described herein are included within the scope of the present invention. In fact, any substrate and coating solution that are compatible with the dip coating method can be employed in the present invention.

The substrate may have a hollow, endless configuration and defines a top region (a non-imaging area), a center region (an imaging area), and an end region (a non-imaging area). The precise dimensions of these three substrate regions vary in embodiments. As illustrative dimensions, the top region ranges in length from about 10 to about 50 mm, and preferably from about 20 to about 40 mm. The center region may range in length from about 200 to about 400 mm, and preferably from about 250 to about 300 mm. The end region may range in length from about 10 to about 50 mm, and preferably from about 20 to about 40 mm. The substrate may have an outside diameter of at least about 170 mm, such as an outside diameter ranging for example from about 170 mm to about 400 mm, and a wall thickness ranging for example from about 0.01 to about 30 mm.

Between dip coating steps, a part of the solvent from the wet coated layer may be removed by exposure to ambient air (i.e., evaporation process) for a period of time ranging for example from about 1 to about 20 minutes, preferably from about 5 to about 10 minutes. Thus, in embodiments, the present method removes a portion of the wetness from an earlier deposited layer prior to depositing another layer on top of the earlier deposited layer. The coated layer is sufficiently dry with no fear of contamination of the next coating solution when gentle rubbing with a finger or cloth fails to remove any of the coated layer.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness from about 50 Angstroms to about 30 micrometers, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX® 447 (available from ICI Americas, Inc.), and the like. If desired, a conductive substrate can be coated onto an insulating material. In addition, the substrate can comprise a metallized plastic, such as titanized or aluminized MYLAR®. The substrate can be flexible or rigid, and can have any number of configurations such as a cylindrical drum, an endless flexible belt, and the like.

Each coating solution may comprise materials typically used for any layer of a photosensitive member including such layers as a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, and 4,797,337, the disclosures of which are totally incorporated herein by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like. In embodiments, the same material can function as an adhesive layer and as a charge blocking layer.

In embodiments, a charge generating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating solution comprises: 2% by weight hydroxy gallium phthalocyanine; 1% by weight terpolymer of vinyl acetate, vinyl chloride, and maleic acid; and 97% by weight cyclohexanone.

In embodiments, a charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4,4'diamine; 14% by weight poly(4,4'-diphenyl-1,1'-cyclohexane carbonate) (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After all the desired layers are coated onto the substrates, they may be subjected to elevated drying temperatures such as from about 100 to about 160° C. for about 0.2 to about 2 hours.

In one embodiment of the present method, a layer of the charge generating solution is applied prior to deposition of a layer of the charge transport solution. Where an optional undercoat layer (e.g., an adhesive layer or a charge blocking layer) is desired, the undercoat layer is applied first to the substrate, prior to the deposition of any other layer.

Subsequent to dip coating the extended substrate unit, the substrate extension device is separated from the substrate. A manual process by an operator or automated equipment can be used to separate the substrate extension device from the substrate before or after drying.

Other modifications of the present invention may occur to those skilled in the art based upon a reading of the present disclosure and these modifications are intended to be included within the scope of the present invention.

We claim:

1. A coating method for a hollow substrate comprising:

(a) forming a seamed extended substrate unit comprised of a substrate extension device defining a layer receiving surface and the substrate, and employing a chuck assembly to internally grip the substrate wherein there is a seam between the substrate and the rest of the extended substrate unit, wherein the substrate extension device is engaged with the substrate, and wherein the substrate extension device is hollow and the chuck assembly extends through the substrate extension device and into the substrate to internally grip the substrate;

(b) dip coating the extended substrate unit while the chuck assembly internally grips the substrate to deposit a layer first on the substrate extension device and then on the substrate; and (c) separating, subsequent to the dip coating the extended substrate unit, the substrate extension device from the substrate.

2. The method of claim 1, wherein the dip coating is accomplished such that the layer thickness on the substrate is more uniform than the layer thickness on the substrate extension device.

3. The method of claim 1, wherein the substrate extension device is permanently coupled to the chuck assembly.

4. The method of claim 1, wherein the substrate extension device is detachably coupled to the chuck assembly.

5. The method of claim 1, wherein the substrate extension device is not coupled to the chuck assembly.

6. The method of claim 1, wherein the substrate is cylindrically shaped.

7. The method of claim 1, wherein the substrate extension device and the substrate are cylindrically shaped having the same outer width, resulting in the outer surface along the entire length of the substrate extension device being parallel to the outer surface of the substrate.

8. The method of claim 1, wherein a portion of the outer surface of the substrate extension device is inclined in a direction to engage the substrate.

9. The method of claim 1, wherein the seam is fluid-tight.

* * * * *